US005280812A

United States Patent [19]

Bigelow

[11] Patent Number: 5,280,812

[45] Date of Patent: Jan. 25, 1994

[54] WIREWRAPPING METHOD AND MACHINE

[76] Inventor: Richard S. Bigelow, 1200 Oakwood Rd., Haddonfield, N.J. 08033

[21] Appl. No.: 979,236

[22] Filed: Nov. 20, 1992

[51] Int. Cl.[5] ..... B21F 01/06

[52] U.S. Cl. ..... 140/104; 140/115

[58] Field of Search ..... 140/71 R, 73, 102, 104, 140/115, 119

[56] References Cited

U.S. PATENT DOCUMENTS

| | | | |
|---|---|---|---|
| 1,194,498 | 8/1916 | Henry | 140/73 |
| 2,775,266 | 12/1956 | Fick et al. | 140/115 |
| 4,896,703 | 1/1990 | Testa, Jr. | 140/104 |
| 5,040,573 | 8/1991 | Shepard | 140/104 |

*Primary Examiner*—Lowell A. Larson
*Attorney, Agent, or Firm*—John R. Ewbank

[57] ABSTRACT

A support wire is placed through the hole of a device such as a ceiling clip for suspending an acoustical ceiling, and the wire is bent to provide a layover loop to which the device is slidingly attached, the tail of the layover loop being as long as a significant portion of the perimeter of the layover loop. The wide portion of such loop is placed in the vertical slot of a pivoted faceplate yieldingly urged to a vertical upright position, and the apex [crossover portion] of the loop is positioned in the conical zone in which the conical face have an angle, with respect to the axis of the wire-wrapping shaft of from 30 to 60 degrees. The stem is positioned in a slot substantially coaxially with the shaft, with the tail in the slot of said rotatable shaft. When the shaft is rotated, the conical faces guide the tail to wrap around the precursor to provide from about 2 to about 8 helical wrappings to stabilize the loop to which the clip is slidingly attached. Because of a one-way clutch, the shaft can be manually rotated in one direction to vertically and upwardly align the slot, thereby permitting removal of the product and the insertion of the next precursor. A foot switch is actuated by the operator to initiate and stop the wire-wrapping step. The gear coaxial with the shaft has a slot extending from the zone between the teeth of the gear to its center and sufficiently beyond to accommodate the coaxial stem of the wire.

9 Claims, 3 Drawing Sheets

FIG. 1
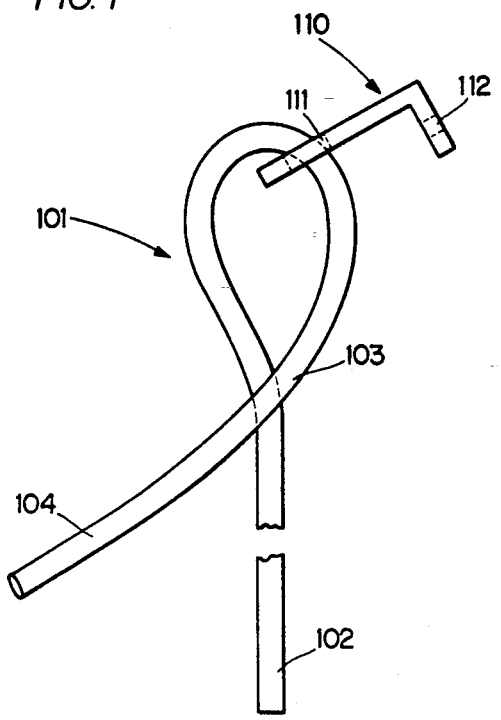
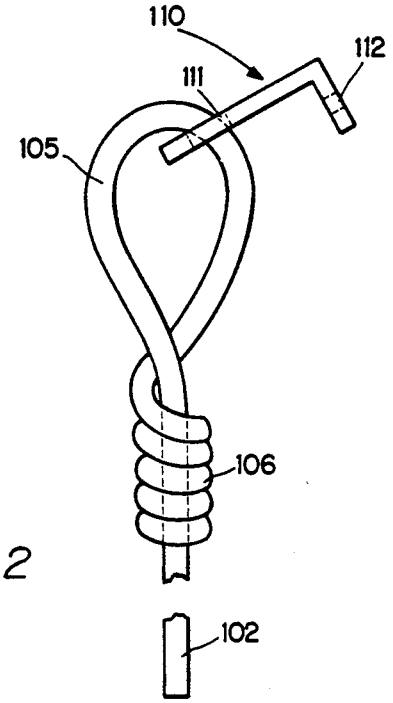
FIG. 2
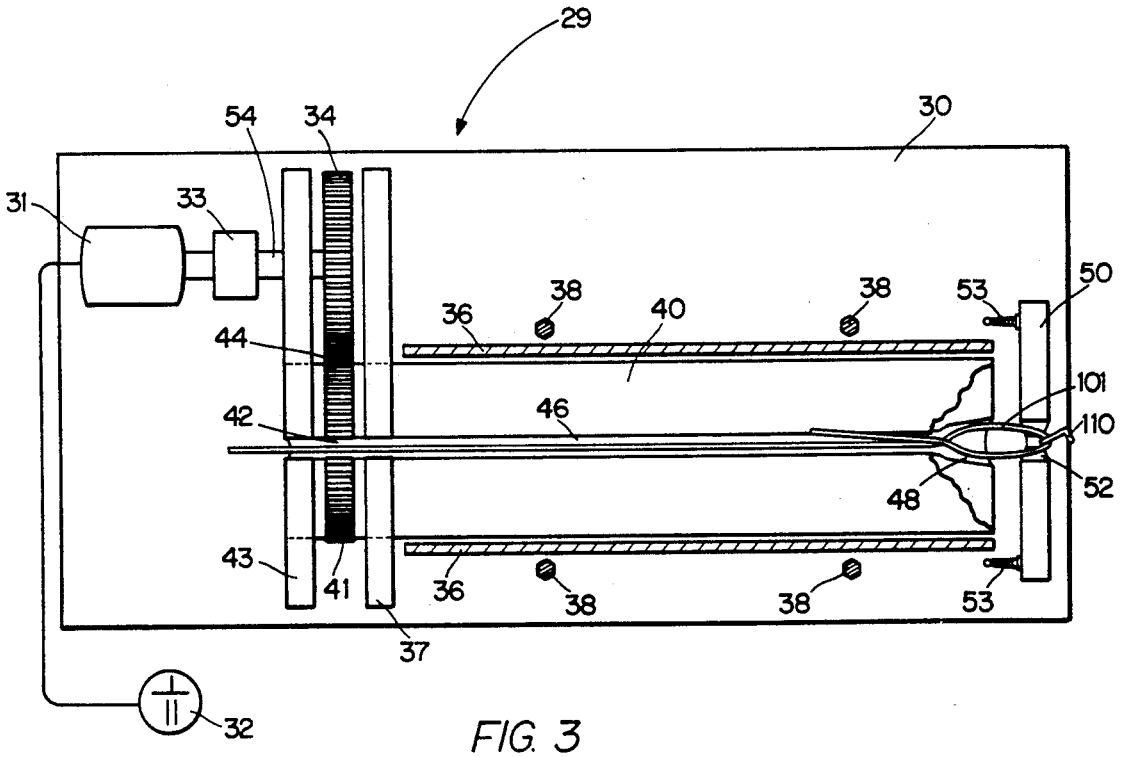
FIG. 3

WIREWRAPPING METHOD AND MACHINE

PRIOR ART

In a typical suspended ceiling, panels of acoustical material rest upon supporting members which are suspended from the ceiling by a plurality of wires. When installing the wires into the ceiling, a device, partaking of the nature of a bracket, is anchored into the ceiling, so that a wire, looped through a hole in the device, can be suspended from the ceiling. Many methods of wire-wrapping cannot adapt to wrapping a wire in which a device is slidingly held within the loop. The usefulness of a ceiling wire for installing a suspended ceiling is dependent upon such positioning of the clip prior to wire-wrapping.

Prior installers of suspended ceilings have sometimes manually bent the tail of the P-loop about the stem of the wire to provide a useful wire for suspending a ceiling. Some machines have been designed for factory preparation of wires having clips slideably attached thereto. Some multi-purpose wire-wrapping machines suitable for many purposes have sometimes been employed in making "ceiling wires" but such multi-purpose equipment has been too costly for widespread usage. Notwithstanding the long standing demand, few machines sufficiently portable for convenient use on the construction project have been available, and none has captured any significant portion of the market.

If the wrapping of the wire about the stem is not sufficiently tight, then a readily expandable-contractible loop is formed which fails to maintain the reliable height of the suspension of the ceiling. At different projects, ceiling wires of various diameters are employed, necessitating the need for a wire-wrapping machine to accommodate to a plausible range of wire-diameters. For convenience, the product of the present invention is sometimes designated as a "ceiling wire" which embraces various products comprising a wire having some device, such as a clip, slideably fitted onto the loop formed by the wire-wrapping operation.

SUMMARY

In accordance with the present invention, a ceiling wire is prepared by a method which includes the steps of: manually putting the end of a wire through the hole of a device such as a ceiling clip; bending the wire so that the clip slides along the loop of a layover loop in which the stem [that is, the principal length of the wire] represents the vertical segment of the P-loop. Because the loop is usually shaped so that it resembles a teardrop, the tail extends at an angle which differs from the right angle of the tail of some Ps in some fonts, but it is convenient to refer to it as the tail of a P-loop. The loop is positioned in the vertical slot of a face-plate, whereby such loop does not rotate when the shaft is rotated. The stem of the wire is placed in the bottom of the principal portion of a long slot in a wirewrapping shaft, so that it is coaxial with such shaft. Near the forward face of such wirewrapping shaft is a helix-growth chamber. A conical zone connects such helix-growth zone with the principal portion of such slot. Such placement of the stem in the slot is accomplished while the shaft is stationary and while the slot is aligned substantially upwardly vertical, so that the slot is open at the top. The tail of the precursor extends substantially upwardly and rearwardly from the conical zone, a portion of the tail being in said slot, so that the rotation of the shaft rotates the tail about the stem.

The shaft is rotated to cause successive portions of such tail to wrap tightly about the stem. At the most forward portion of the shaft, there is a cylindrical helix-growth chamber extending from the forward face to a depth of about two to five diameters of the wire, and having a diameter of slightly more than three diameters of the wire. Between the principal slot and such helix-growth chamber is a conical zone in which the conical face, with respect to the axis of the shaft, has an angle between 30 and 60 degrees. Such conical surface guides a portion of the tail to be wrapped tightly about the stem. Successive wrappings, from about 3 to about 8, are achieved by the action of the slot and conical surfaces. At least the first two wrappings of the helix are thus pushed into the helix-growth zone. If the depth of the helix-growth zone is sufficiently shallow, then such initial wrappings of the helix will be pushed out of the helix-growth zone as the further wrappings are wound. Such shaft rotation is continued, whereby more of the tail is wrapped tightly around the stem. If the first two wrappings are advanced out of the cylindrical chamber, they might press against a face plate pivoted and yieldingly urging such face plate toward an upright position very slightly forward of the front face of the shaft. Such shaft rotation is continued until all of the tail is thus wrapped tightly about the stem. The power required for wrapping the wire is significantly greater than the power required for rotating the shaft after the wrapping is finished. Hence, the operator can hear the difference in the noise from the wire wrapping machine, and terminate the power to the motor promptly after or concurrently with the end of such wrapping. Because the operator needs both hands for inserting and removing the wires from the machine, such control is desirably actuated by a body member other than a hand. A foot switch is suitable for starting and stopping the electric motor. After the motor has stopped, the radial position of the shaft 40 is adjusted so that the slot 46 is aligned in a substantially upwardly vertical position. The loop is pulled slightly forward, thereby advancing all of the helix outside of the conical and cylindrical chambers, and tilting the face-plate downwardly by overcoming its rearward urging action. The thus released ceiling wire 54 is then removed from its slot.

If desired, the shape of the bottom of the slot 46 in shaft 40 can be formed by first drilling an axial hole in the shaft 40, having a diameter of about 110% of the diameter of the contemplated largest size wire to be used. If so, a slot having a width substantially equal to such contemplated wire diameters then cut, the midline of such slot being substantially radial. Then the circumferential width of the slot is substantially doubled by a non-radial cut directed toward the pre-established bottom of the slot. Thus, at the shaft's circumference, the slot is wide enough to permit easy insertion of the stem. The stem of the wire rests slideably at the bottom of such slot. It is essential that such stem not rotate during the normal wire-wrapping rotation of the shaft and that the stem be readily slideable axially. Because the advancing face of such tapered slot is substantially radial, and the trailing face is significantly non-radial, the tail is effectively fed toward the conical wire-wrapping zone in which successive portions of the tail are wrapped about the stem.

Particular attention is called to the shallow cylindrical chamber adapted to accommodate the freshly formed portion of the helix created by the wire-wrapping. The diameter of such chamber is approximately four [from about 3.1 to about 4.9] diameters of the contemplated wire. It is essential that the helix be advanced through such chamber. Because the helix-accommodating chamber is shallow, having a depth of only about two [from about 1.6 to about 2.9] diameters of the contemplated wire, it imposes excessive friction on the system.

It should be especially noted that the conical zone directs the tail to wrap tightly around the stem very tightly, and minimizes any propensities for the formation of a helix having a significantly protruding tail. The conical zone effectively wraps the succeeding portions of the tail around the stem, substantially without regard to the angle between the stem and the principal portion of the tail. The long slot in the shaft effectively rotates the tail around the stationary stem of the precursor whether the angle between the stem and tail is 30 degrees or 90 degrees or in between, or even outside the likely range. The large diameter of the conical zone corresponds generally to the diameter of the cylindrical zone, and the small diameter of the conical zone corresponds to the diameter of the bottom of the slot, so that the pertinent dimension of the conical zone is the effective angle of the conical surface with respect to the axis. In accordance with the present invention, such angle must be within the range from 30 to 60 degrees.

Insertion of the stem of the precursor in the slot, or removal of the stem of the completed ceiling wire is accomplished while the slot is at or near its top dead center position, that is, with the slot upwardly vertical. Manual rotation of the gear box by which the rotation speed of the motor is converted into a more readily observed rotation speed is not feasible. In accordance with the present invention, a one-way clutch is provided in the power train rotating the wire-wrapping shaft, whereby the shaft can be readily rotated in one direction to reposition the slot at or near top dead center.

As a general rule, any attempt to transmit power through a C-shaped gear having a wide radial slot extending to the axis, leads to gradual closing of such slot, attributable to the strains inherent in power transmission. However, the present invention features a C-shaped gear coaxial with the wire-wrapping shaft, and having a slot between two teeth which extends to the axis. Such gear meshes with a gear having substantially the same diameter, whereby the strains of speed reduction are avoided. The intermeshing of such shaft gear with the gear driving it desirably features a plurality of teeth, so that when the slot is aligned with the line between the two axes of the gears, the power is transmitted by a plurality of relatively high teeth, as distinguished from the intermeshing of shallow teeth. Such requirements for deep teeth spaced far enough apart to permit the slot to extend to the axis without squeezing the gap requires use of a pair of gears having a diameter several times the diameter of the wire-wrapping shaft.

The strains on a gear tooth are greatest at start-up, particularly in a wire-wrapping machine. In accordance with the present invention, the intermeshing zone between the gears comprising the slotted gear is angularly remote from the top dead center zone from which the start-up of rotation is regularly scheduled.

While the wire-wrapping machine is wrapping the tail upon the stem to convert a precursor into a ceiling wire, the operator is normally threading the end of a wire through the hole of a clip, and bending a wire into a loop to prepare another precursor. Both hands of the operator are thus normally busy during the operation of the method of the present invention. A foot switch is provided for starting and stopping the power driving system such as an electric motor. Skilled operators develop proficiency in learning how to stop the driving system so that the slot is at or near its top dead center position desired for removal and/or insertion of a stem out of or into the machine. By reason of the one-way clutch in the drive system, the shaft can be manually readjusted to the desired substantially top dead center position without regard to its angular position upon stopping. Thus the wire wrapping system avoids the complexities and potential unreliability of systems relying upon consistently stopping only at the desired substantially top dead center position.

Important advantages accrue from minituarizing the equipment so much as to adapt it for use at the project site, so that the operator can produce ceiling wires having unique characteristics developed because of the discovery of unexpected problems during the project.

When coping with the problems of a range of wire sizes which are thirtyfold, it is necessary to use machines designed for wires of different sizes. However, the present invention has been shown to be practical for about a threefold range of sizes. The diameter of the bottom of the slot is normally about 110% of the maximum size of wire suitable for such shaft. Any wire to be wrapped must have at least a slightly smaller diameter than such diameter of the axial [and narrowest] portion of the slot. The stem must fit loosely enough to be slideable axially and to permit the shaft to rotate about the stationary stem of the wire. Hence the wire diameter cannot exceed about 91% of the diameter of the bottom of the slot. The minimum size of wire is about 80% of such maximum diameter.

It is the combination of the recited features which has stimulated enthusiasm for the present invention, the interaction and interdependence of the features enhancing the attractiveness of the system. The wire-wrapping shaft has a slot wider at the circumference than at the axis, where the diameter of the bottom corresponds to about 110% of the maximum wire size contemplated for the apparatus. At the forward end of the wire-wrapping shaft, a cylindrical helix-accommodating chamber is provided having a diameter of about 3.1 to 4.9, and desirably about 4, and a depth of about 1.6 to about 2.9 and desirably about 2 times the maximum contemplated wire diameter. A conically shaped wire-wrapping zone is immediately rearward of such helix-accommodating zone, the small diameter of the cone being substantially the same as, and connecting with, the bottom of the slot, and the large diameter being substantially the same as, and connecting with, that of the cylindrical helix-accommodating zone. The effective angle of the conical surfaces must be within the range from 30 to 60 degrees in accordance with the present invention. The surfaces in the conical zone need not be purely conical, but may have curves. It is the pressure of the appropriately sloped conical surface which shapes the tail to wrap around the stem.

The one-way clutch in the power train makes feasible the manual adjustment of the shaft to a position of about top dead center, whereby the stem can be inserted or removed from the slot. Coaxial with the shaft is a C-shaped gear having a slot having the width of the circumferential width of the slot on the shaft, said slot extending to the axis. Such gear has sufficiently large teeth and sufficiently large diameter that the intermeshing zone between such C-shaped gear and its mate [unslotted, but otherwise substantially the same] is angularly remote from the top dead center position.

The foot-actuated control for starting and stopping the rotation of the shaft makes it feasible for the operator to attach a clip within a loop for preparing a precursor, so that a precursor comprising an upwardly extending tail can be positioned in the slot of the shaft. If the motor is actuated by compressed air or hydraulic fluid, such control by the operator would not be a switch but a motor control. Such motor control should be actuated other than by the hand, the foot switch being illustrative of how to liberate the hands for wire-bending, etc.

A face plate has a slot which accommodates the wide portion of the loop, so that the stem does not rotate with the shaft, but so that the upwardly extending tail assuredly does rotate with the shaft for wrapping the wire as a helix about the stem. Such faceplate is resiliently urged toward a vertical position, but is pivoted so that it can tilt when the wire-wrapping forms a helix of many turns, and so that it can be manually shifted toward a horizontal position when removing the ceiling wire from the machine.

The portability of the machine for use at the project site helps to distinguish the present invention from most wire wrapping machines.

DESCRIPTION OF DRAWINGS

FIG. 1 is a schematic showing of a precursor member comprising a support clip slideably connected in the loop of a P-shaped wire, formed by bending a loop near the end of a wire so that the tail of the wire extends a distance which is a significant portion of the perimeter of the loop.

FIG. 2 is a schematic showing of the product of the present invention, sometimes conveniently designated as a ceiling wire, comprising a long stem, a loop at one end, and a member slideably connected to the wire in the loop, and the loop being stable by reason of the helical wrapping of the tail-wire about the stem.

FIG. 3 is a top schematic view of one embodiment of the wire-wrapping machine of the present invention.

DESCRIPTION OF A PREFERRED EMBODIMENT

Figure 4:
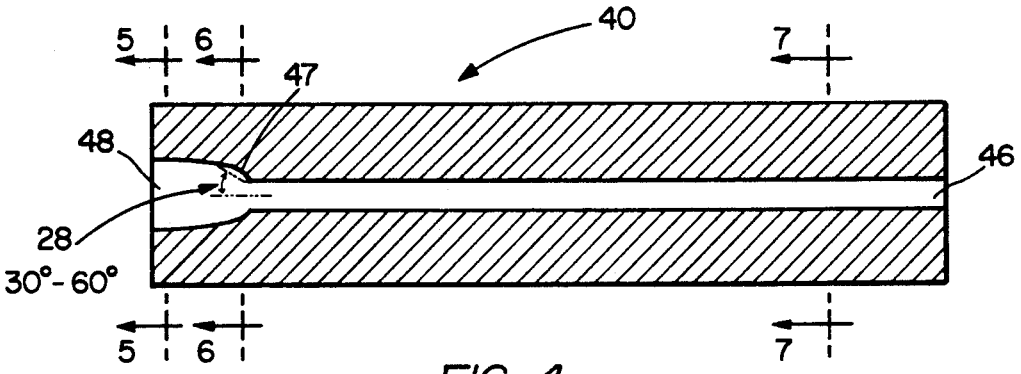
FIG. 4 is a sectional view of the wire-wrapping shaft.

Referring now to the drawings, and particularly FIGS. 1 and 2, there is shown a precursor 101, formed by bending [ordinarily manually] the end of a wire having a long stem 102 after threading such wire through a hole 111 of a device 110 such as a bracket clip for anchoring the wire to the ceiling. The bracket 110 can have a hole 112 too be used when anchoring the clip to the ceiling. The end of a precursor wire is directed through a hole 111 in device 110, and then the wire is bent to form both a layover loop 103 and a tail 104. It is called a layover loop because one portion of the wire is laid over another portion. Although the loop is desirably shaped analogously to a teardrop, it is convenient to describe the loop as if it were the loop of a P-shaped wire, with the tail of the P extending a distance corresponding to a significant portion of the perimeter of the loop of the P. A stem 102 of the precursor 101 comprises the main length of the precursor. The product of the present invention, conveniently called a "ceiling wire" [notwithstanding the utility for a great variety of purposes for the combination of a device slideably connected in a loop at the end of a wire stem] comprises the stem 102, loop 105, and helical wrapping 106. The clip 110 has a hole 111 through which a portion of loop 105 passes, so that the clip can slide along a portion of the loop 105. The helical wrapping 106 is sufficiently tight that the loop 105 is stable.

Figure 11:
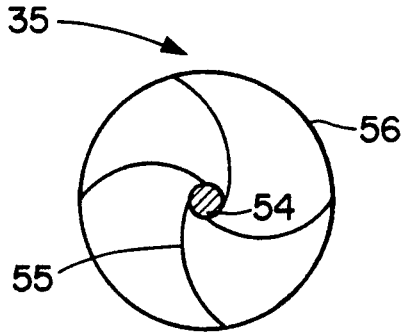
FIG. 11. is a schematic view of a one-way clutch adapted to permit manual reverse rotation of the wire-wrapping shaft without encountering the frictional resistance from the gearbox.
Figure 12:
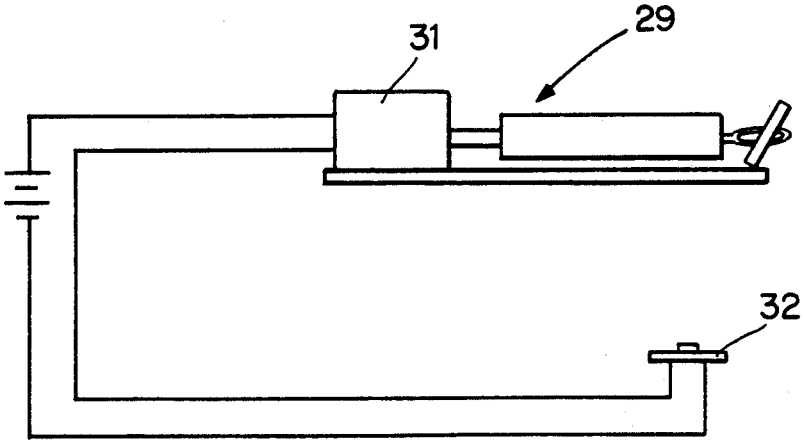
FIG. 12 schematically shows a foot-actuated control for starting or stopping the powered rotation of the shaft.

As shown in FIG. 3, a wire-wrapping machine 29 comprises a base 30 supporting a motor 31 which can be started or stopped by a control 32, adapted to be actuated by the foot [or an appropriate body member other than a hand] of the operator, shown schematically in FIG. 12. In a preferred embodiment, said motor is an electric motor, but a motor powered by compressed air or hydraulic fluid might be appropriate for some applications. The motor 31 drives a gear box 33, having a driveshaft 54 transmitting power, through a one-way clutch 35, to gear 34, shown schematically in FIG. 11. Such one way clutch 35 permits the power to be transmitted in one direction from the gear box 33 to the gear 34 through such one-way clutch 35, and also permits manual rotation of gear 34 in the opposite direction without encountering the friction of gear box 33.

For illustrative purposes, the machine can be described as it would be designed for use with wire having about ⅛ inch diameter, only slightly larger than wire known as #12 gauge suspension wire. Wire as small as about 7/64 inch can also be processed in the machine, but large wire, such as ¼ inch wire, would require that the shaft be appropriately designed for such wire. A shield 36 is supported on the base 30 by standards 38, which are shown sectionally in FIG. 3. Said shield 36 is C-shaped. Because the shield 36 is shown sectionally, its lengthwise slot 39 is not shown, but serves to permit the stem to be inserted or removed from the machine. Such slot 39 is at the top dead center position, so that a stem 102 of a precursor 101 can be inserted into the machine.

Figure 10:
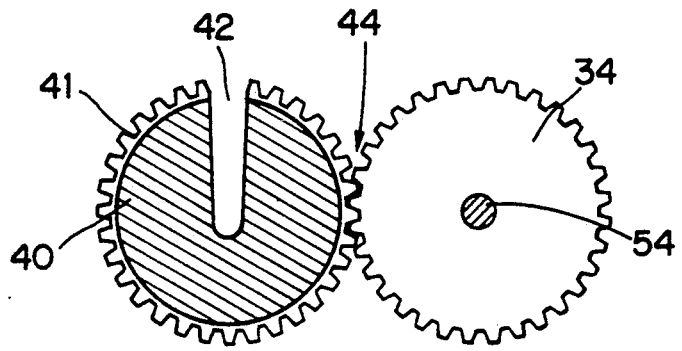
FIG. 10 is a schematic showing of a C-shaped gear having a slot extending from between two teeth to slightly beyond the axis, said slotted gear intermeshing with a generally similar mated gear lacking such slot.

A wire-wrapping shaft 40 is coaxial with and thus driven by a slotted gear 41. A slot 42 in said gear 41 extends from a zone between two teeth and extends radially inwardly to slightly beyond the axis, so that the stem 102 of precursor can be positioned at the bottom of said slot 42 and be coaxial with shaft 40 and gear 41. The shaft 40 has its rear bearing in rearplate 43. As shown schematically in FIG. 10, an intermeshing zone 44 between gears 34 and 41 is angularly remote from the top dead center position of the slot 42 in gear 41. The gears 34 and 41 are shielded by rearwall 43 and wall 37. It is important that the distance between two adjacent teeth on gears 34 and 41 be at least as great as such width of the slot 42. The high torque of starting is not imparted to squeeze slot 42 because each fabrication starts when the slot 42 is at top dead center instead of at the intermeshing zone 44. The slot 42 is slightly wider than the ⅛ inch diameter of the stem 102 of precursor 101. For example, the slot could be 5/32 or even 3/16 inch wide, so that the stem 102 can be readily moved through the slot when inserting or removing a wire, and so that the stem 102 can slide axially when at the bottom of the slot 42.

Figure 5:
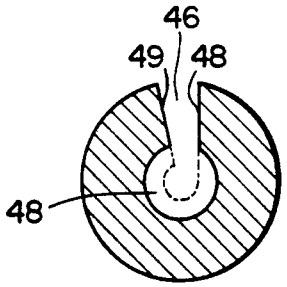
FIGS. 5, 6, and 7 are cross-sectional views taken on lines 5—5, 6—6, and 7—7 of FIG. 4.

The shaft 40 has a tapered slot 46 which extends from the circumference to just beyond the axis, so that when a stem 102 is placed at the bottom of the slot 46, it is substantially coaxial with said shaft. At the circumference, said slot 46 is about ¼ inch, or twice the diameter of the contemplated wire, as shown in FIG. 5. Near the axis, the diameter of the curved bottom of the slot 46 corresponds generally to the width of slot 42, such as 5/32 or 3/16 inch, and thus is slightly greater than the diameter of the contemplated wire. An advancing face 48 of the clockwise rotating shaft 40 is substantially radial, but a trailing face 49 is nonradial because the slot tapers down to the rounded axial zone, as shown in FIG. 5. Thus a wire can be readily inserted into the slot 46, and can rest on the bottom of the slot so that it can be easily slid axially while remaining coaxial with the shaft.

As shown in cross sectional FIG. 5, slot 46 has an advancing face 48 which is nearly radial with respect to shaft 40, resulting from the milling of a slot from the circumference radially to the pre-drilled hole at the axis. Then the circumferential width of slot 46 is doubled by cutting the trailing face 49 toward said axial hole.

Figure 6:
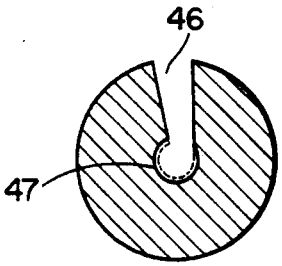
Figure 7:
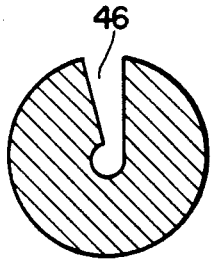
Figure 8:
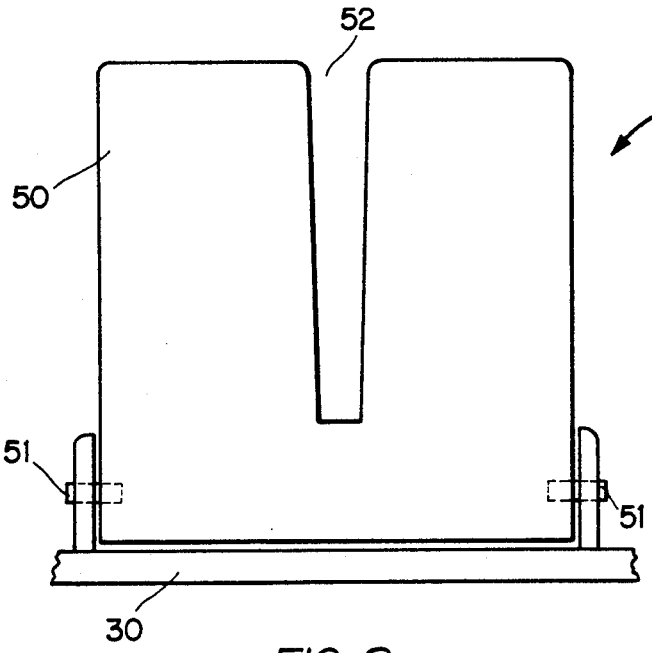
FIG. 8 is a front schematic view of a pivotable faceplate.
Figure 9:
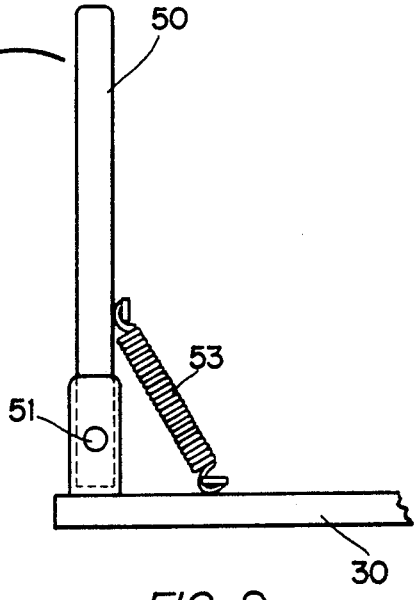
FIG. 9 is a side view of said pivotable face plate.

At the front or face end of the shaft 40, there is a helix growth chamber 48, shown in FIGS. 4 and 5, and absent from FIGS. 6 and 7. The back wall of such helix growth chamber 48 is a conical face 47 extending from the cylindrical wall of the helix growth chamber 48 to the slot 46. Such conical face 47 serves to guide the wrapping of the tail 104 about the precursor 101 so that the resulting helical wrapping 106 is sufficiently tight that the loop 105 is stable. The small diameter of such conical face 47 in a conical zone corresponds to the diameter of the bottom of slot 46, with which it is connected. The large diameter of such conical face 47 corresponds to the diameter of a helix growth chamber 48, with which it is connected. The diameter of the helix growth chamber is slightly more than three times the wire diameter or about one-half inch, and should be within a range from about 3.1 to about 4.9 times the wire diameter. The depth of the helix growth chamber 48 should be from about 1.8 to about 5.3, desirably 4 times the wire diameter. The helix growth chamber can extend from the face of shaft 40 to a depth of about one half inch. The depth of the conical zone is adjusted to assure an effective angle, designated as 28, of between 30 and 60 degrees relative to the axis. Although conveniently designated as a conical face 47, a cross section thereof can be curved instead of straight. If conical face is curved, then the angle 28 is measured by averaging such curve. Such conical face 47 guides the tail 104 so that it wraps itself tightly around the precursor 101 as the shaft 40 and tail 104 rotate about the non-rotating precursor 101.

Particular attention is directed to the effectiveness of said conical face 47 and said helix growth chamber 48 in producing a stable loop 105 whether the tail 104 is relatively long or relatively short. The precursor is placed in the machine so that the intersection of the tail with the precursor is at the narrow portion of the conical zone. As the shaft 40 and the tail 104 rotate about the precursor 101, a helix is generated, such generation continuing until the tail is consumed in making such helical wrapping. Sometimes the helical wrapping has only about 3 layers, but it can be up to about 9 layers. In order to have precursor on which to wrap, the stem 102 is axially shifted forward.

A faceplate 50 is attached to base 30 by pivoting means 51. Appropriate resilient means, such as a plurality of springs 53, urges such face plate toward a normally vertical position, but when desired, the faceplate can be tilted forward toward the horizontal position. During operation of the machine, the faceplate 50 may be tilted forwardly as the helical wrapping emerges from the helix growth chamber 48.

After the tail 104 has been wrapped completely as a helical wrapping 106, the control 32 can be actuated to halt the motor 31 and rotation of shaft 40. The faceplate 50 can be tilted forward, and the loop 105 can be lifted upwardly, and the ceiling wire can be removed from both the faceplate 50 and the slot 46 in shaft 40. In order to remove the ceiling wire, and also in order to insert another precursor, the shaft is manually adjusted [if necessary] by slightly rotating it so that the slot 46 of shaft 40 is at top dead center, such adjustment being plausible because the one way clutch 35 permits manual rotation of the shaft 40 in a counter-clockwise direction, notwithstanding the frictional resistance of the gear box 33 in clockwise rotation of the shaft 40. Numerous modifications are possible without departing from the claims.

The invention claimed is:

1. In the method of preparing a product featuring a device slideably held in a stable loop at the end of a wire, the improve ment which comprises the steps of:

directing an end of a wire through a hole in a device;

forming a layover loop so that said device is slidingly held in said layover loop, there being a tail sufficiently long to represent a significant portion of the perimeter of such layover loop, said combination of long stem, layover loop, tail, and device being a precursor;

positioning the precursor so that its stem is substantially coaxial with a wirewrapping shaft having a slot, the tail extending into said slot, with the layover zone of the loop adjacent conical faces of the wirewrapping shaft, said wirewrapping shaft having a helix-growth chamber at its forward face, said positioning of the precursor including the positioning of the layover loop in a vertical slot of a faceplate forward of the forward face of said wire wrapping shaft;

and rotating said shaft while said vertical slot in the face plate prevents the rotation of the stem of said wire, whereby the tail is rotated about the stem and directed by such conical faces to wrap tightly around the stem within said helix growth chamber, thereby creating from about 3 to about 8 helical wrappings to stabilize the loop having the device slidingly held therein.

2. In a wire wrapping machine adapted to form from a precursor a product consisting of a stem, a stable loop secured by a plurality of helical wrappings of the wire about itself, a device slidingly attached to the loop, said wire wrapping machine comprising a base, a motor, power transmission means, and a wire-wrapping shaft, the improvement which consists of:

slot means throughout the length of said wire-wrapping shaft, said slot accommodating a wire in a substantially coaxial relationship with said shaft, and said slot being approximately twice as wide at its circumference as at its axis, the advancing face of said slot being substantially radial, and the trailing face being significantly nonradial;

a coaxial helix growth chamber having a diameter about 3.1 to about 4.9 times the diameter of the contemplated wire and a depth from the front face of said shaft which is from about 1.8 to about 5.3 times the diameter of contemplated wire;

and a coaxial conical zone in said shaft connecting said helix growth chamber with the main portion of said slot, the effective angle of the conical face with respect to the axis of the shaft being between about 30 and 60 degrees.

3. The wire wrapping machine of claim 2 in which a faceplate having a vertical slot is positioned forwardly of the forward face of the shaft, in which a loop of the precursor is positioned in said faceplate slot to prevent the rotation of the stem of such precursor during the rotation of the shaft and tail, said faceplate being pivoted so that it may be pushed forward toward a horizontal position and so that spring means normally yieldingly urge the faceplate to a vertical position, said shaft, when the motor is not rotating, being manually rotatable in one direction without encountering the frictional resistance attributable to the power transmission means by reason of a one-way clutch between said shaft and said power transmission means, in which the shaft is coaxial with and rotating with a gear driven by a substantially similar gear, the distance between the teeth tips of each gear being at least substantially double the diameter of the contemplated wire, and the gear coaxial with and revolving with the shaft having a slot extending from between two teeth to sufficiently past the axis to provide alignment with the bottom of the slot in said shaft, the starting and stopping of the rotation of the shaft being controlled by a device actuated by a body part other than the hand, said wire wrapping machine being portable for use at a construction site.

4. The wire wrapping machine of claim 2 in which a faceplate has a vertical slot in which a loop of the precursor-product is positioned to prevent any rotation of the stem of the precursor during the rotation of the shaft and tail, said faceplate being positioned on the base forward of the forward face of the shaft.

5. The wire wrapping machine of claim 4 in which the faceplate is pivoted so that it may be pushed forward toward a horizontal position, and so that spring means yieldingly urge the faceplate to a vertical position, the product being removed from the machine by tilting the faceplate forwardly briefly prior to lifting the product from the slot in the face-plate.

6. The wire-wrapping machine of claim 5 in which, when the motor is not rotating, the shaft can be manually rotated in one direction without encountering the resistance attributable to the power transmission means by reason of a one-way clutch between said shaft and said power transmission means.

7. The wire wrapping machine of claim 6 in which said shaft is coaxial with a gear driven by a substantially similar gear, the distance between the tooth tips of each gear being at least substantially double the diameter of the contemplated wire, and the gear coaxial with the shaft having a slot extending from at least a portion of the space between two teeth to sufficiently beyond the axis to provide alignment with the bottom of the slot in said shaft.

8. The wire wrapping machine of claim 7 in which the starting and stopping of the rotation of the shaft is controlled by a device actuated by a body part other than a hand.

9. The wire wrapping machine of claim 8 which is sufficiently portable for use at a construction site.

* * * * *